United States Patent [19]

Borland et al.

[11] Patent Number: 5,071,594

[45] Date of Patent: Dec. 10, 1991

[54] FREE FLOWING GRANULAR LAUNDRY DETERGENT COMPRISING TERT-AMINE OXIDE DIHYDRATE

[75] Inventors: James E. Borland; Kim R. Smith, both of Baton Rouge, La.

[73] Assignee: Ethyl Corporation, Richmond, Va.

[21] Appl. No.: 591,214

[22] Filed: Oct. 1, 1990

Related U.S. Application Data

[63] Continuation-in-part of Ser. No. 416,143, Oct. 2, 1989, abandoned.

[51] Int. Cl.[5] ..... C11D 3/07; C11D 3/066

[52] U.S. Cl. ..... 252/528; 252/547; 252/DIG. 1; 564/298

[58] Field of Search ..... 252/528, 544, 547, DIG. 1; 564/298

[56] References Cited

U.S. PATENT DOCUMENTS

| | | | |
|---|---|---|---|
| 3,215,741 | 11/1965 | Chadwick | 564/298 |
| 3,489,687 | 1/1970 | Inamorato et al. | 252/547 |
| 3,657,251 | 4/1972 | Smetana | 564/298 |
| 4,276,205 | 6/1981 | Ferry | 252/528 |
| 4,299,739 | 11/1981 | Esposito et al. | 252/545 |
| 4,320,033 | 3/1982 | Yoshikawa | 252/547 |
| 4,659,565 | 4/1987 | Smith et al. | 252/547 |
| 4,921,627 | 5/1990 | Copeland et al. | 252/547 |
| 4,960,934 | 10/1990 | Smith et al. | 564/298 |

FOREIGN PATENT DOCUMENTS

| | | |
|---|---|---|
| 12997 | 1/1984 | Japan . |
| 2219594 | 12/1989 | United Kingdom . |

*Primary Examiner*—Prince E. Willis
*Assistant Examiner*—J. Silbermann
*Attorney, Agent, or Firm*—Patricia J. Hogan

[57] ABSTRACT

A free-flowing granular heavy duty laundry detergent is made by blending with a detergent builder (e.g. Zeolite A) and optional other ingredients a discrete tert-amine oxide wherein the molecules correspond to the formual $RR'R''NO.2H_2O$ in which R is a primary alkyl group containing 8-24 carbons; R' is methyl, ethyl, or 2-hydroxyethyl; and R'' is independently selected from methyl, ethyl, 2-hydroxyethyl, and primary alkyl groups containing 8-24 carbons.

18 Claims, No Drawings

FREE FLOWING GRANULAR LAUNDRY DETERGENT COMPRISING TERT-AMINE OXIDE DIHYDRATE

CROSS-REFERENCE-TO RELATED APPLICATION

This application is a continuation-in-part of copending application Ser. No. 416,143, filed Oct. 2, 1989, now abandoned.

FIELD OF INVENTION

The invention relates to heavy duty laundry detergents and more particularly to such detergents comprising tert-amine oxides.

BACKGROUND

As taught in U.S. Pat. No. 3,489,687 (Inamorato et al.), U.S. Pat. No. 4,276,205 (Ferry), and U.S. Pat. No. 4,659,565 (Smith et al.), it is known that mixed tert-amine oxides containing alkyl groups of different chain lengths can be used in conjunction with other materials, such as other surfactants, detergent builders, and/or other additives, to prepare liquid or solid detergents.

The mixed tert-amine oxides which have been synthesized by conventional techniques, i.e., the typical aqueous solutions of mixed tert-amine oxides, present no particular problems in the preparation of liquid detergents in which their water content is not a liability. However, they have to be dried in order to be used in the preparation of solid detergents.

The technique used by Inamorato et al. to dry their aqueous tert-amine oxides is to mix them with sufficient amounts of hydratable inorganic salts, such as sodium sulfate or sodium tripolyphosphate, to react with substantially all of the water in the solution. Using this technique, they form a friable amine oxide/hydrated salt mixture which they can granulate to obtain a free-flowing detergent composition.

When Ferry uses tert-amine oxides to prepare solid detergents, he spray-dries the aqueous solutions—a technique that is effective in removing the water but has the unfortunate side-effect of subjecting the amine oxides to temperatures at which they are apt to decompose and form amines that are corrosive to the skin.

SUMMARY OF INVENTION

It has now been discovered that free-flowing granular heavy duty laundry detergents can be obtained by dry mixing with a laundry detergent builder and optionally also with other laundry detergent components a discrete tert-amine oxide wherein the molecules correspond to the formula RR'R''NO $nH_2O$ in which R is a primary alkyl group containing 8–24 carbons; R' is methyl, ethyl, or 2-hydroxyethyl; R'' is independently selected from methyl, ethyl, 2-hydroxyethyl, and primary alkyl groups containing 8–24 carbons; and n is 0, 1, or 2, at least some of the molecules being dihydrate molecules. The formulations thus obtained ordinarily contain 1–30%, preferably 5–30%, and most preferably 10–25% by weight of the tert-amine oxide and 10–50% by weight of the detergent builder.

DETAILED DESCRIPTION

The tert-amine oxide employed in the practice of the invention is a dihydrate or dihydrate-containing material which may be prepared by the process of copending application Ser. No. 591426 (Smith et al.), filed Oct. 1, 1990, the teachings of which are incorporated herein by reference.

In the preparation of these tert-amine oxides, a mixed tert-amine is oxidized with an aqueous hydrogen peroxide having a concentration of 50–90% by weight at 20°–100° C., preferably about 25°–80° C., in the presence, at least during the latter part of the reaction, of an organic solvent in which the tert-amine and tert-amine oxide are soluble at the reaction temperature but in which the tert-amine oxide is insoluble at a lower temperature; and the water content of the product, if not inherently such as to provide a water/tert-amine oxide mol ratio not higher than about 2.1/1 because of the amount of aqueous hydrogen peroxide used, is adjusted to achieve such a ratio before the tert-amine oxide is recovered. When this mol ratio is in the range of about 1.9–2.1/1, the product that is recovered is a dihydrate; when the mol ratio is lower than about 1.9/1, the product contains some dihydrate molecules as well as other molecules indicated by the above formula.

Mixed tert-amines which may be employed in the reaction are tert-amines which contain one or two short-chain groups independently selected from methyl, ethyl, and 2-hydroxyethyl groups, with the remaining valences of the amino nitrogen being satisfied with long-chain groups independently selected from primary alkyl groups containing 8–24 carbons, e.g., octyl, decyl, dodecyl, tetradecyl, hexadecyl, octadecyl, eicosyl, docosyl, and tetracosyl groups. The primary alkyl groups may be branched-chain groups, but the preferred amines are those in which at least most of the primary alkyl groups have a straight chain.

Exemplary of these tert-amines are N-octyldimethylamine, N,N-didecylmethylamine, N-decyl-N-dodecylethylamine, N-dodecyldimethylamine, N-tetradecyldimethylamine, N-tetradecyl-N-ethylmethylamine, N-tetradecyl-N-ethyl-2-hydroxyethylamine, N,N-di-tetradecyl-2-hydroxyethylamine, N-hexadecyldimethylamine, N-hexadecyldi-2- hydroxyethylamine N-octadecyldimethylamine, N,N-dieicosylethylamine, N-docosyl-N-2-hydroxyethylmethylamine, N-tetracosyldimethylamine, etc.

As in conventional reactions of this type, the aqueous hydrogen peroxide is employed in at least a stoichiometric amount, generally about 1.1–1.3, preferably about 1.15–1.25 times the stoichiometric amount; and it is ordinarily preferred to use an amount that will inherently lead to the desired water/tert-amine oxide mol ratio in the product.

Utilizable solvents include a variety of liquids, such as esters, hydrocarbons, halohydrocarbons, and highly polar aprotic solvents; but the esters, especially ethyl acetate, are apt to be preferred. The amount of solvent added to the reaction mixture is an amount sufficient to keep the reaction mixture fluid and stirrable throughout the reaction. Although it is generally preferred to use the minimum amount of solvent required for stirrability and to insure minimization of this amount by initiating the reaction in the absence of the solvent and adding solvent only as needed to maintain stirrability, the entire reaction may be conducted in the presence of the solvent and/or an excess of solvent may be utilized.

Recovery of the tert-amine oxide may be accomplished by conventional means, such as distillation. However, it is preferred to recover the amine oxide by taking advantage of the nature of the organic solvent and simply cooling the product to a temperature at which the amine oxide is no longer soluble in the solvent, allowing the oxide to precipitate, and separating the precipitate by filtration. When this preferred recovery technique is used, it is generally most preferred to dilute the product with additional organic solvent before precipitation is allowed to occur.

Regardless of the particular manner in which it is recovered, the amine oxide product is a solid which can therefore be incorporated into the detergent formulation as discrete particles. When the amine oxide is a dihydrate, it has the added advantage of being non-hygroscopic.

The detergent builder which is mixed with the tert-amine oxide in the practice of the invention is one or more of the materials conventionally employed as detergent builders, e.g., sodium aluminum silicates, such as Zeolite A; sodium tripolyphosphate (STPP); sodium salt of nitrilotriacetic acid; sodium carbonate, bicarbonate, or citrate; potassium carboxymethyloxymalonate; sodium carboxymethyloxysuccinate; sodium salt of ethylenediaminetetraacetic acid (EDTA); sodium pyrophosphate; and the like. The most preferred detergent builders are sodium carbonate, STPP, and Zeolite A.

Although the amount of builder used can be about 10–85% by weight of the composition or an even higher amount, it is preferably about 20–80%, most preferably about 30–50% by weight.

As already mentioned, the laundry detergent of the invention may also contain other conventional laundry detergent components. Among the components most likely to be included are (A) water-soluble bulk fillers, such as sodium sulfate, which are typically incorporated into laundry detergent formulations so as to constitute about 5–50% of their weight in order to facilitate handling, (B) optical brightening agents, such as 4,4'-bis(triazin-2-ylamino)stilbene-2,2'-disulfonic acid, 2-(stilben-4-yl)naphthotriazole, 1,4-bis(styryl)benzene, 1,3-diphenyl-2-pyrazoline, and the like, (C) dry peroxygen bleaches, such as sodium perborate, (D) bleach activators, such as sodium acyloxybenzene sulfonate, (E) anti-redeposition agents, such as sodium polyacrylate, and (F) one or more additional surfactants.

When additional surfactants are used together with the essential amine oxide surfactants, they may be anionic, cationic, amphotertic, or nonionic.

Exemplary of the anionic surfactants that may be used are:

(A) sodium, potassium, ammonium, and hydroxyalkylammonium fatty acid soaps, such as the sodium salts of tallow, coco, oleic, and stearic acids, (B) sodium, potassium, ammonium, and hydroxyalkylammonium salts of alkylbenzenesulfonic acids in which the alky groups contain 10–16 carbons, such as sodium tridecylbenzenesulfonate, (C) sodium, potassium, ammonium, and hydroxyalkylammonium salts of alpha-olefin sulfonates or alkyl sulfates containing 12–16 carbons, (D) alkali metal salts of alkyl glyceryl ether sulfonates and sulfates such as the alkyl monoglyceride sulfonates and sulfates in which the alkyl groups contain 12–16 carbons, (E) the alkali metal salts of alkylphenyl polyethoxysulfonates and sulfates containing about 5–10 ethylenoxy units per molecule and having 8–12 carbons in the alkyl groups, (F) water-soluble salts of alkyl esters of alpha-sulfonated fatty acids having 2–10 carbons in the alkyl moiety and 12–16 carbons in the alkanoic moiety, (G) fatty alcohol sulfates and ether sulfates, and (H) alkyl polyethoxysulfates having 12–18 carbons in the alkyl groups.

Other surfactants that may be used include, e.g., (A) cationics such as quaternary ammonium, phosphonium, and sulfonium compounds containing at least one detergent-range (e.g., 12–18 carbons) alkyl group, like dodecyldimethylammonium chloride, (B) amphoteric surfactants such as hexadecyldimethylbetaine and other alkyldimethylbetaines in which the alkyl group contains 12–18 carbons, and (C) nonionics such as the polyethyleneoxy (5–10 units) alcohols containing 12–16 carbons (e.g., dodecanol) or alkylphenols in which the alkyl groups contain 5–10 carbons (e.g., nonylphenol).

The following examples are given to illustrate the invention and are not intended as a limitation thereof. Unless otherwise specified, quantities mentioned are quantities by weight.

EXAMPLE 1

Preparation of Amine Oxide

Charge a suitable reaction vessel with 100 g (0.41 mol) of N-tetradecyldimethylamine and 0.5 g (1.27 mmols) of diethylenetriaminepentaacetic acid. Heat the mixture with stirring to 65° C., add 23 g (0.47 mol) of 70% aqueous hydrogen peroxide dropwise over a 15-minute period, then raise the temperature to 75°–76° C., and stir at that temperature for seven hours while adding 34 mL of ethyl acetate dropwise as needed to maintain a clear, gel-free liquid. Recover the product by adding the crude reaction mass to 400 mL of ethyl acetate and cooling to 15° C. to precipitate non-hygroscopic white crystals, which analysis shows to be N-tetradecyldimethylamine oxide dihydrate, a solid having a melting point of about 41° C. The recovered yield is 86%.

EXAMPLES 2–46

Laundry Deterqent Formulations

Prepare 45 heavy duty laundry detergent formulations containing 10 parts of water, 20 parts of sodium sulfate, 2 parts of sodium carboxymethoxycellulose, 8 parts of sodium silicate, 40 parts of sodium tripolyphosphate (STPP) and/or Zeolite A (ZA) as a detergent builder, and 20 parts of one or more surfactants including the N-tetradecyldimethylamine oxide dihydrate (AOD) of Example 1 and optionally also sodium tridecylbenzene sulfonate as an anionic surfactant (AS), nonylphenol ethoxylate as a nonionic surfactant (NS), hexadecyldimethylbetaine as an amphoteric surfactant (AmS), and/or dodecyltrimethylammonium chloride as a cationic surfactant (CS). The types and amounts of surfactants and builders used in each formulation are shown below.

TABLE 1

| | 2 | 3 | 4 | 5 | 6 | 7 |
|---|---|---|---|---|---|---|
| AOD | 20 | 20 | 20 | 10 | 10 | 10 |
| AS | 0 | 0 | 0 | 10 | 10 | 10 |
| STPP | 40 | 0 | 20 | 40 | 0 | 20 |
| ZA | 0 | 40 | 20 | 0 | 40 | 20 |

TABLE 2

| | 8 | 9 | 10 | 11 | 12 | 13 |
|---|---|---|---|---|---|---|
| AOD | 10 | 10 | 10 | 10 | 10 | 10 |
| NS | 10 | 10 | 10 | 0 | 0 | 0 |
| AmS | 0 | 0 | 0 | 10 | 10 | 10 |

TABLE 2-continued

| | 8 | 9 | 10 | 11 | 12 | 13 |
|---|---|---|---|---|---|---|
| STPP | 40 | 0 | 20 | 40 | 0 | 20 |
| ZA | 0 | 40 | 20 | 0 | 40 | 20 |

TABLE 3

| | 14 | 15 | 16 | 17 | 18 | 19 |
|---|---|---|---|---|---|---|
| AOD | 10 | 10 | 10 | 10 | 10 | 10 |
| CS | 10 | 10 | 10 | 0 | 0 | 0 |
| AS | 0 | 0 | 0 | 5 | 5 | 5 |
| NS | 0 | 0 | 0 | 5 | 5 | 5 |
| STPP | 40 | 0 | 20 | 40 | 0 | 20 |
| ZA | 0 | 40 | 20 | 0 | 40 | 20 |

TABLE 4

| | 20 | 21 | 22 | 23 | 24 | 25 |
|---|---|---|---|---|---|---|
| AOD | 10 | 10 | 10 | 10 | 10 | 10 |
| AS | 5 | 5 | 5 | 5 | 5 | 5 |
| AmS | 5 | 5 | 5 | 0 | 0 | 0 |
| CS | 0 | 0 | 0 | 5 | 5 | 5 |
| STPP | 40 | 0 | 20 | 40 | 0 | 20 |
| ZA | 0 | 40 | 20 | 0 | 40 | 20 |

TABLE 5

| | 26 | 27 | 28 | 29 | 30 | 31 |
|---|---|---|---|---|---|---|
| AOD | 10 | 10 | 10 | 10 | 10 | 10 |
| NS | 5 | 5 | 5 | 5 | 5 | 5 |
| AmS | 5 | 5 | 5 | 0 | 0 | 0 |
| CS | 0 | 0 | 0 | 5 | 5 | 5 |
| STPP | 40 | 0 | 20 | 40 | 0 | 20 |
| ZA | 0 | 40 | 20 | 0 | 40 | 20 |

TABLE 6

| | 32 | 33 | 34 | 35 | 36 | 37 |
|---|---|---|---|---|---|---|
| AOD | 10 | 10 | 10 | 10 | 10 | 10 |
| AmS | 5 | 5 | 5 | 0 | 0 | 0 |
| CS | 5 | 5 | 5 | 5 | 5 | 5 |
| AS | 0 | 0 | 0 | 3 | 3 | 3 |
| NS | 0 | 0 | 0 | 2 | 2 | 2 |
| STPP | 40 | 0 | 20 | 40 | 0 | 20 |
| ZA | 0 | 40 | 20 | 0 | 40 | 20 |

TABLE 7

| | 38 | 39 | 40 | 41 | 42 | 43 |
|---|---|---|---|---|---|---|
| AOD | 10 | 10 | 10 | 10 | 10 | 10 |
| CS | 5 | 5 | 5 | 5 | 5 | 5 |
| AS | 3 | 3 | 3 | 0 | 0 | 0 |
| AmS | 2 | 2 | 2 | 2 | 2 | 2 |
| NS | 0 | 0 | 0 | 3 | 3 | 3 |
| STPP | 40 | 0 | 20 | 40 | 0 | 20 |
| ZA | 0 | 40 | 20 | 0 | 40 | 20 |

TABLE 8

| | 44 | 45 | 46 |
|---|---|---|---|
| AOD | 10 | 10 | 10 |
| AS | 3 | 3 | 3 |
| NS | 3 | 3 | 3 |
| AmS | 2 | 2 | 2 |
| CS | 2 | 2 | 2 |
| STPP | 40 | 0 | 20 |
| ZA | 0 | 40 | 20 |

Each of the formulations provides a free-flowing detergent.

What is claimed is:

1. A free-flowing heavy duty granular laundry detergent comprising (A) 1-30% by weight of a discrete tert-amine oxide wherein the molecules correspond to the formula $RR'R''NO.2H_2O$ in which R is a primary alkyl group containing 8-24 carbons; R' is methyl, ethyl, or 2-hydroxyethyl; and R'' is independently selected from methyl, ethyl, 2-hydroxyethyl, and primary alkyl groups containing 8-24 carbons and (B) 10-50% by weight of a detergent builder.

2. The laundry detergent of claim 1 wherein R is a linear primary alkyl group containing 12-24 carbons.

3. The laundry detergent of claim 2 wherein R' and R'' are methyl.

4. The laundry detergent of claim 1 wherein the builder is a member of the group consisting of sodium tripolyphosphate, sodium carbonate, sodium nitrilotriacetate, sodium aluminum silicate, and mixtures thereof.

5. The laundry detergent of claim 1 which contains at least one surfactant in addition to the tert-amine oxide.

6. The laundry detergent of claim 5 wherein the additional surfactant is an anionic surfactant.

7. The laundry detergent of claim 6 wherein the anionic surfactant is a sodium alkylbenzene sulfonate in which the alkyl group contains 10-18 carbons.

8. The laundry detergent of claim 5 wherein the additional surfactant is a no ionic surfactant.

9. The laundry detergent of claim 8 wherein the nonionic surfactant is an ethoxylate of an alkylphenol in which the alkyl group contains 6-12 carbons.

10. The laundry detergent of claim 5 wherein the additional surfactant is an amphoteric surfactant.

11. The laundry detergent of claim 10 wherein the amphoteric surfactant is an alkyl dimethylbetaine in which the alkyl group contains 12-20 carbons.

12. The laundry detergent of claim 5 wherein the additional surfactant is a cationic surfactant.

13. The laundry detergent of claim 12 wherein the cationic surfactant is an alkyltrimethylammonium chloride in which the alkyl group contains 10-16 carbons.

14. The laundry detergent of claim 1 comprising (A) 5-30% by weight of N-tetradecyldimethylamine oxide dihydrate, (B) 80% by weight of zeolite A, (C) 5-30% by weight of a sodium alkylbenzene sulfonate in which the alkyl group contains 10-18 carbons, and (D) 10-60% by weight of sodium carbonate.

15. The laundry detergent of claim 1 comprising (A) 5-30% by weight of N-tetradecyldimethylamine oxide dihydrate and (B) 70-95% by weight of sodium tripolyphosphate.

16. A process for preparing a free-flowing heavy duty granular laundry detergent which comprises dry mixing a discrete tert-amine oxide wherein the molecules correspond to the formula $RR'R''NO.2H_2O$ in which R is a primary alkyl group containing 8-24 carbons; R' is methyl, ethyl, or 2-hydroxyethyl; and R'' is independently selected from emthyl, ethyl, 2-hydroxyethyl, and primary alkyl groups containing 8-24 carbons; with laundry detergent components comprising a detergent builder.

17. The process of claim 16 comprising dry mixing (A) 5-30% by weight of a discrete solid non-hygroscopic N-tetradecyldimethylamine oxide dihydrate, (B) 20-80% by weight of zeolite A, (C) 5-30% by weight of sodium alkylbenzene sulfonate in which the alkyl group contains 10-16 carbons, and (D) 10-60% by weight of sodium carbonate.

18. The process of claim 16 comprising dry mixing (A) 5-30% by weight of a discrete solid non-hyqroscopic N-tetradecyldimethylamine oxide dihydrate, (B) 20-80% by weight of sodium tripolyphosphate, (C) 5-30% by weight of a sodium alkylbenzene sulfonate in which the alkyl group contains 10-16 carbons, and (D) 10-60% by weight of sodium carbonate.

* * * * *